US010704242B2

(12) United States Patent
Strandvall

(10) Patent No.: US 10,704,242 B2
(45) Date of Patent: Jul. 7, 2020

(54) SINK PLUG ARRANGEMENT

(71) Applicant: OY PREVEX AB, Nykarleby (FI)

(72) Inventor: Sören Strandvall, Nykarleby (FI)

(73) Assignee: OY PREVEX AB, Nykarleby (FI)

( * ) Notice: Subject to any disclaimer, the term of this patent is extended or adjusted under 35 U.S.C. 154(b) by 0 days.

(21) Appl. No.: 16/226,681

(22) Filed: Dec. 20, 2018

(65) Prior Publication Data

US 2019/0119891 A1 Apr. 25, 2019

Related U.S. Application Data

(63) Continuation of application No. PCT/EP2017/065125, filed on Jun. 20, 2017.

(30) Foreign Application Priority Data

Jun. 20, 2016 (SE) ..... 1650862

(51) Int. Cl.

| | |
|---|---|
| ***E03C 1/23*** | (2006.01) |
| ***A47K 1/14*** | (2006.01) |
| ***E03C 1/262*** | (2006.01) |

(52) U.S. Cl.

CPC ..... *E03C 1/2306* (2013.01); *A47K 1/14* (2013.01); *E03C 1/262* (2013.01); *E03C 2001/2311* (2013.01)

(58) Field of Classification Search

CPC ..... E03C 1/2306; E03C 1/2302; E03C 1/23
USPC ..... 4/286–295
See application file for complete search history.

(56) References Cited

U.S. PATENT DOCUMENTS

| | | | | |
|---|---|---|---|---|
| 8,146,181 | B2 * | 4/2012 | Gaus | A47L 15/4223 137/550 |
| 2014/0075662 | A1 * | 3/2014 | Gayoso | E03C 1/2306 4/287 |

FOREIGN PATENT DOCUMENTS

| | | | |
|---|---|---|---|
| DE | 2708893 | A1 | 9/1978 |
| DE | 3644480 | A1 | 7/1988 |
| EP | 2853645 | A1 | 4/2015 |
| JP | 2014152500 | A | 8/2014 |
| WO | 2004/100742 | A1 | 11/2004 |

* cited by examiner

*Primary Examiner* — Lauren A Crane
(74) *Attorney, Agent, or Firm* — Gabriela B. Tomescu, Esq.; Bergenstråhle & Partners AB

(57) ABSTRACT

Disclosed is a sink plug. The sink plug comprises an integrally formed bottom part (10) having a floor (20) and side walls (30). The sink plug further comprises a knob (40) with magnetic properties, disposed on the center of the circular floor and a cover (70) adapted to be disposed on the knob. The cover comprises a magnet (50) disposed in the center of the cover (70), wherein in an operating position, the magnet (50) magnetically engages with the knob (40).

7 Claims, 4 Drawing Sheets

SINK PLUG ARRANGEMENT

This application is the continuation of International Application No. PCT/EP2017/065125, filed 20 Jun., 2017, which claims the benefit of Swedish Patent Application No. SE 1650862-4, filed 20 Jun., 2016, the entire contents of which are hereby incorporated by reference.

TECHNICAL FIELD

The present solution relates to a sink plug with a magnetic function, for preventing or allowing liquids to pass through the plug and into a sink outlet.

BACKGROUND ART

Sinks, such as sinks for restrooms or kitchens, typically comprise sink plugs or sink stoppers that are used to facilitate two states, the first stopping water from leaving through the sink outlet, and the second allowing it. During use, sink plugs are subjected to water, salt, grease and many other substances that are disposed of through sinks. This creates a hostile environment, which puts certain requirements on the parts used in a sink plug.

In addition to the functionality of either preventing or allowing flow of liquids, sink plugs may be customized in various ways to achieve other functionalities.

A problem with current sink plugs is that they get damaged over time, due to being subjected to the previously mentioned substances. Thus, it would be desirable to provide sink plugs that are more durable than prior art. Furthermore, it would also be desirable to provide sink plugs with other types of functionalities than are available on the market today.

SUMMARY

It is an object of the solution to address at least some of the problems and issues outlined above. It is possible to achieve these objects and others by using a sink plug and a sink plug arrangement according to the present disclosure.

The above sink plug and sink plug arrangement may be configured and implemented according to different optional embodiments. Further possible features and benefits of this solution will become apparent from the detailed description below.

According to a first aspect, there is provided a sink plug. The sink plug comprises an integrally formed bottom part having a floor and side walls, a knob with magnetic properties, disposed on the center of the circular floor, and a cover adapted to be disposed on the knob. The cover comprises a magnet disposed in the center of the cover, wherein in an operating position, the magnet magnetically engages with the knob. The sink plug is adjustable between a first position and a second position. The first position is a position in which the removable cover and the floor of the bottom part are substantially parallel and spaced apart, and substantially perpendicular to a vertical axis. The second position is a position in which the floor is substantially perpendicular to the vertical axis and wherein the cover is at an angle of approximately 10° to 45° relative to the floor. Further, in the second position, the underside (80) of the top part (70) engages with the top part of the knob (40), such that the top part is locked in place by engaging with the bottom part (10) and the underside (80) of the top part (70).

Typically, the diameter of the cover is smaller than the diameter of the bottom part.

In some embodiments, a bottom part of the cover is adapted to engage with the knob in the second position, such that the sink plug may be removed from a sink in the second position.

According to a second aspect, there is provided a sink arrangement. The sink arrangement comprises a sink, a sink outlet and a sink plug according to the first aspect, connected to the sink outlet. The sink arrangement has a first state and a second state, wherein the first state is a sealed state in which no fluids may pass through the sink plug into the sink outlet, and the second state is an open state in which fluids ay pass through the sink plug to the sink outlet.

According to a third aspect, there is provided a sink plug according to the first aspect, wherein the angle between the cover and the floor in the second position is between 0° and 90°.

The aspects and embodiments described herein are freely combinable with each other. There are optional embodiments of the second aspect and third aspect that correspond to the optional embodiments of the first aspect.

SHORT DESCRIPTION OF THE DRAWINGS

The solution will now be described, by way of example, with reference to the accompanying drawings, in which.

DESCRIPTION OF EMBODIMENTS

In the following, a detailed description of the different embodiments of the solution is disclosed with reference to the accompanying drawings. All examples herein should be seen as part of the general description and are therefore possible to combine in any way in general terms. Individual features of the various embodiments may be combined or exchanged unless such combination or exchange is clearly contradictory to the overall function of the implementation.

Briefly described, the invention relates to a sink plug, i.e. a connecting device between a sink and a sink outlet, the outlet in turn being connected to a drain. The invention further relates to a sink plug arrangement, comprising a sink plug, a sink and a sink outlet.

The sink plug and the sink plug arrangement utilizes the understanding that magnets may be preferable to moving parts and/or mechanical parts from a durability perspective, depending on the intended use, while also providing a sink plug with more and better functionality than sink plugs that are currently available. This functionality includes the possibility to, in an efficient manner, remove waste that has been caught in the sink plug, and the functionality of achieving a bottom area in the sink that is essentially flush and smooth.

Figure 1:
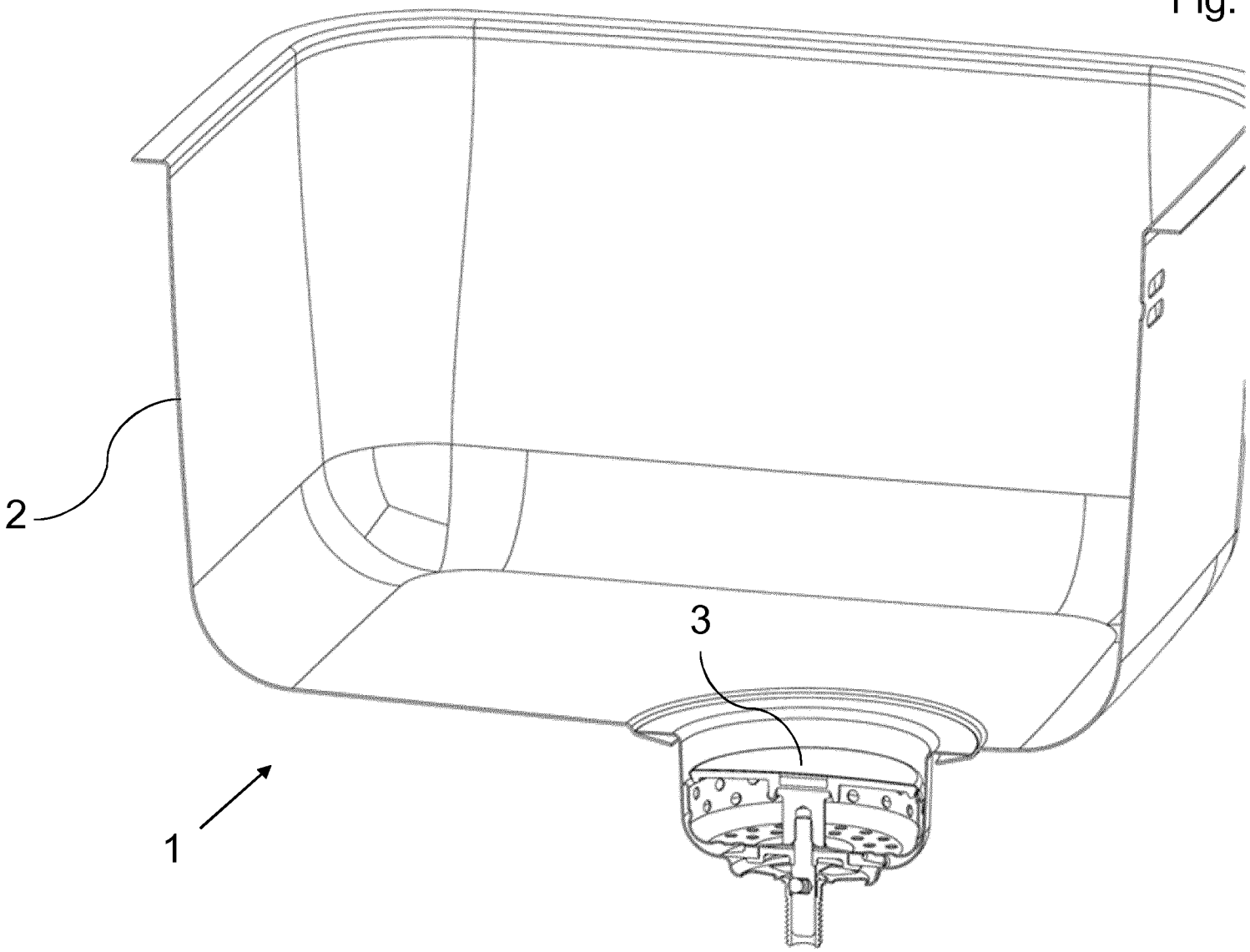
FIG. 1 is a sectional view of a sink plug arrangement comprising a sink, a sink plug and a sink outlet.

FIG. 1 shows a sink plug arrangement 1 according to the present disclosure, comprising a sink 2 and a sink plug 3 connected to a sink outlet. The sink plug 3 is intended to be positioned in the sink 2. In a first state, it is adapted to stop fluids and waste material from flowing through the sink 2, past the sink plug 3 and into the sink outlet 4. In a second state, the sink plug 3 is adapted to stop waste from passing through the sink and into the sink outlet, but to allow for fluids to pass through the sink plug 3 and into the sink outlet.

Figure 2:
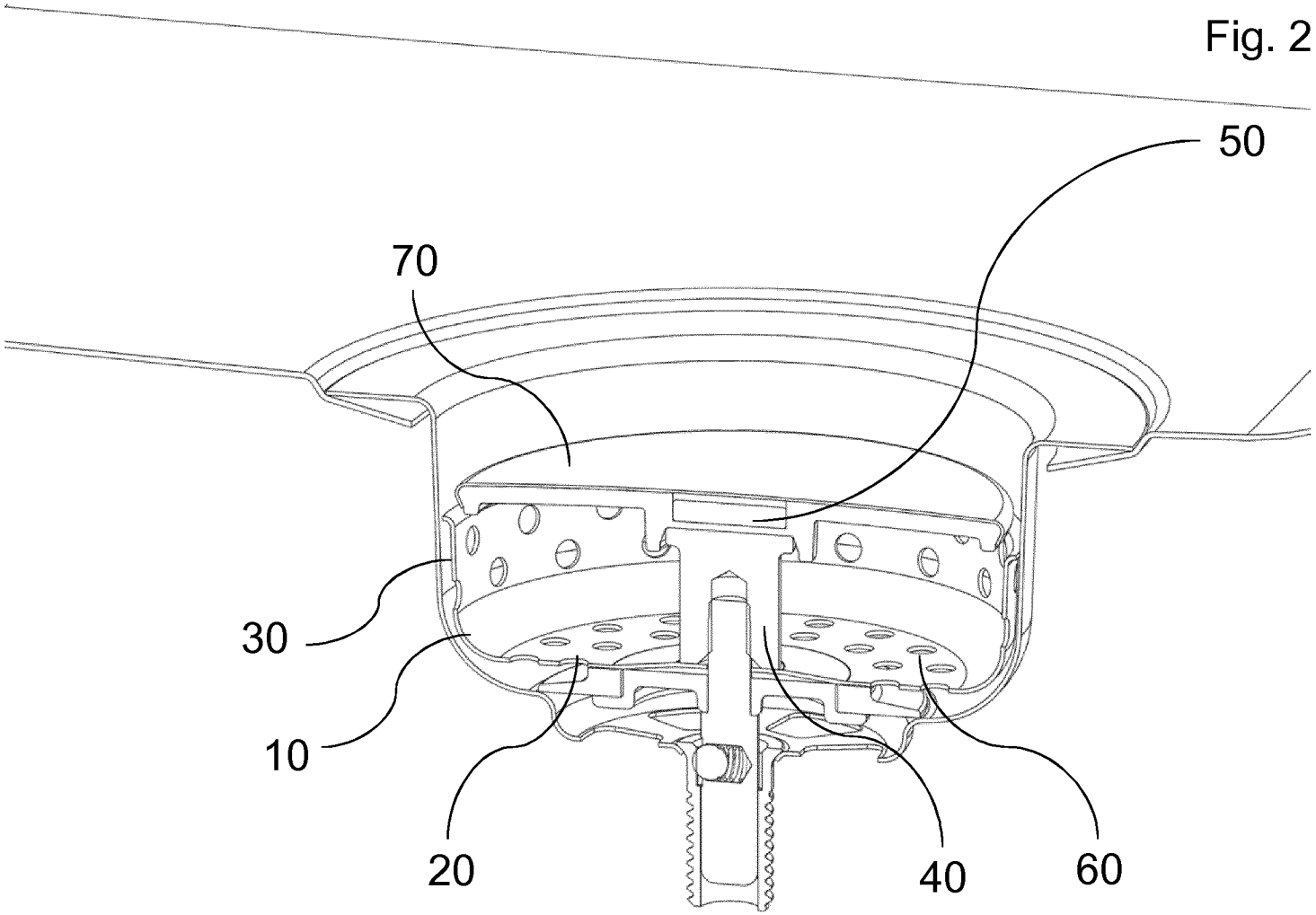
FIG. 2 is a sectional view of the sink plug in a first position.

FIG. 2 shows the sink plug according to the present disclosure in a first position. The sink plug comprises a bottom part 10, preferably generally circular, wherein the bottom part 10 comprises a floor 20 and a side wall 30 surrounding the floor 20, preferably integrally formed. The sink plug further comprises a knob 40, disposed on and in the center of the floor 20. In the first position, the sink plug is essentially flush with the bottom part of the sink, which entails that the bottom area of the sink is continuous and smooth when the sink plug is inserted and is in the first position.

The knob 40 has magnetic properties, such that it may interact with a magnet 50 disposed in the center of a top part 70 of the sink plug. The top part 70 may also be seen as a cover, the terms are used interchangeably throughout this document.

In an operating position, the knob 40 and the magnet 50 are in engagement, such that the knob 40 stabilizes the top part 70 by engaging the magnet 50, in an essentially horizontal position such as the one seen in FIG. 2.

Figure 3:
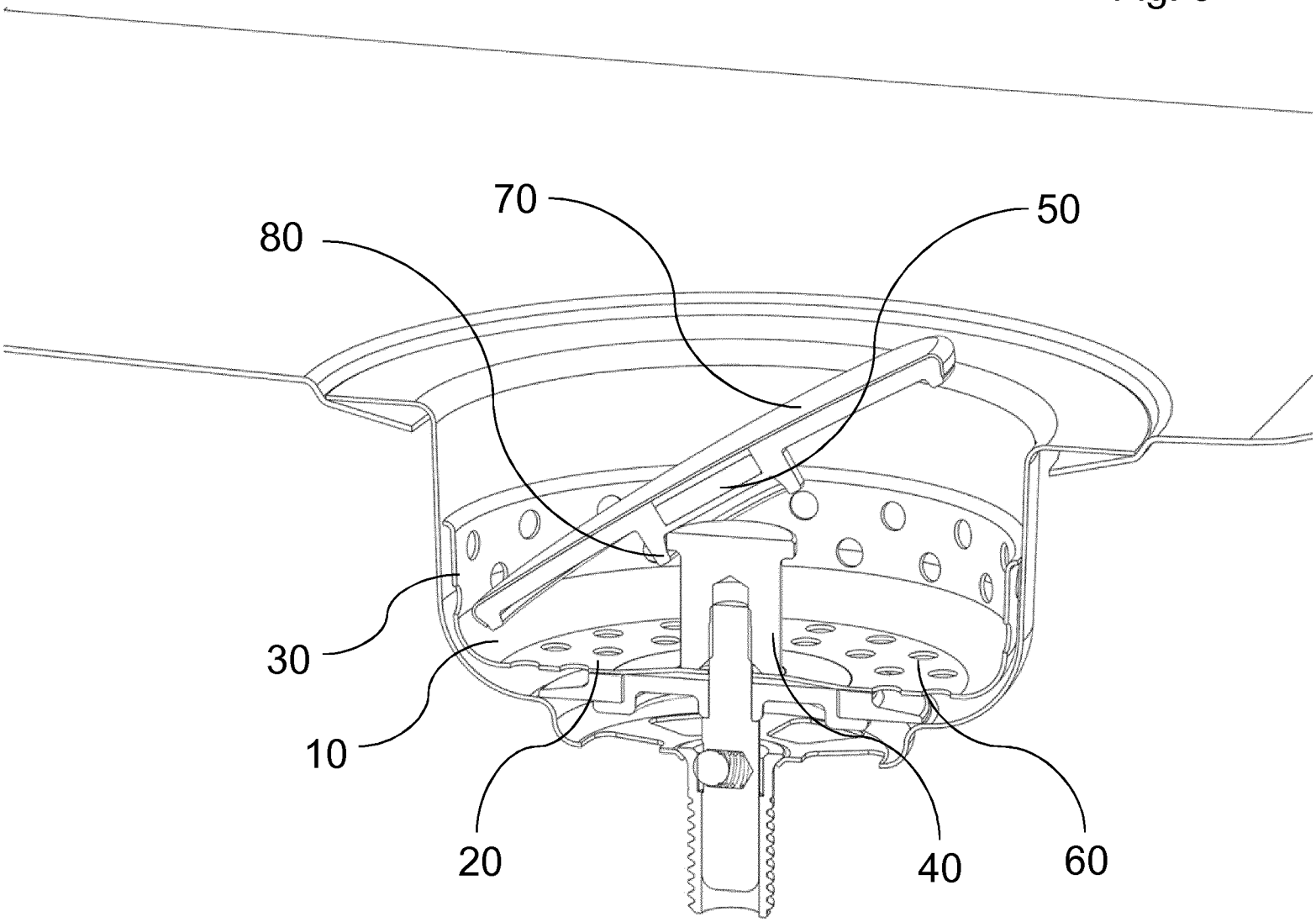
FIG. 3 is a sectional view of the sink plug in a second position.
Figure 4:
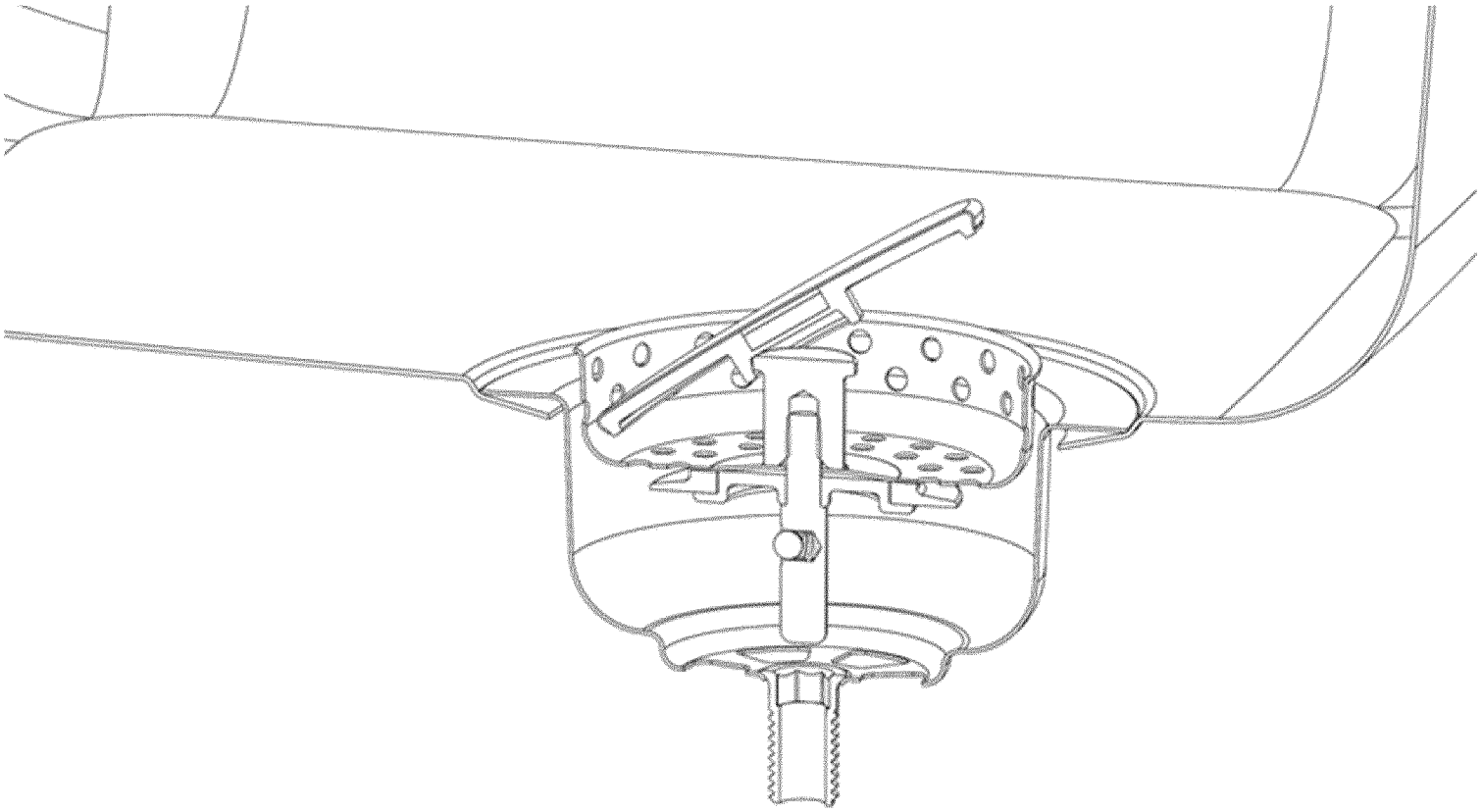
FIG. 4 is a sectional view of the sink plug arrangement, showing how the sink plug is removed and/or inserted into the sink outlet.

Looking now at FIG. 3, the sink plug is shown in a second position in which the sink plug is removable from the sink. In this position, the top part 70 of the sink plug is at an angle relative to the floor part of the sink plug, achieved by e.g. applying pressure on one side of the top part 70 when the sink plug is in an operating position in which the magnet 50 is engaged with the knob 40. In the second position, an underside 80 of the top part 70 engages with the top part of the knob 40, such that the top part is locked in place by engaging with the bottom part 10 and the underside 80 of the top part 70.

The second position shown in FIG. 3 is also a position in which waste that has been caught in the sink plug may be removed, as is evident from the figure. By tilting the top part 70 of the sink plug, the area between the top part 70 and the bottom part 20 becomes accessible to a user, and as such it is possible to remove any possible waste that would be caught in that area. The second position may also allow for larger waste materials to fit into the bottom part 20 of the sink plug.

In order to enable the first and second position of the sink plug, the diameter of the top part of the sink plug is generally smaller than the diameter of the bottom part of the sink plug. However, in some embodiments, the top part of the sink plug may be of the same size or larger than the bottom part. In these embodiments, the second position may be enabled through the knob 40 being movable and following the movement of the top part when it is tilted.

The bottom part of the sink plug may comprise draining holes, for allowing certain substances to pass through the sink plug. By adjusting the size of these draining holes, the size of waste that may pass through the sink plug is also adjusted.

The angle between the bottom part of the sink plug and the top part of the sink plug, when in the second position, may be anything between 0° and 90°, is preferably between 5° and 70°, and more preferably between 10° and 45°. As will be understood, the edge of the top part of the sink plug is easier for a user to interact with when the angle is 45° than when it is 10°. However, when the sink plug is at an angle closer to 10°, waste of larger size is prevented from fitting into the sink plug as compared to when the angle is 45°.

The second position is primarily intended to be used when removing or inserting the sink plug. Due to how the magnet 50 interacts with the knob 40, the second position will in most cases require a constant application of force in order to not revert back to the second position. In some embodiments, the sink plug may be adapted such that the second position may also be used as an operating position, for instance by adding a second magnet that is used to lock the sink plug into the second position.

It should be understood that the first and second state of the sink plug, as described above, differs from the first and second position of the sink plug. The first and second state refer to the relationship between the sink plug and the sink outlet, more specifically to if the sink plug is positioned such that all passage into the sink outlet is prevented, or such that passage of waste material is prevented while passage of water and/or other fluids is enabled.

The first and second position of the sink plug, on the other hand, refers to the relative positioning of the top part of the sink plug and the bottom part of the sink plug. In the first position, the sink plug is adapted to be flush with the bottom area of a sink, such that the area is smooth and would be experienced as essentially continuous by a user who would interact with the area. In the second position, the top part of the sink plug may be gripped by a user, which enables the sink plug to be moved and further enables a user to access the space between the top part and the bottom part of the sink plug.

The first and second position may also interact with the first and second state. As mentioned, the first position of the sink plug is one where the top part is intended to be flush with a floor part of the sink. In some embodiments, the sink plug, in the first position, is adapted to be flush with the sink floor in the first state, and in some embodiments the sink plug may be adapted to be flush with the sink floor in the second state.

Although the description above contains a plurality of specificities, these should not be construed as limiting the scope of the concept described herein but as merely providing illustrations of some exemplifying embodiments of the described concept. It will be appreciated that the scope of the presently described concept fully encompasses other embodiments which may become obvious to those skilled in the art, and that the scope of the presently described concept is accordingly not to be limited. Reference to an element in the singular is not intended to mean "one and only one" unless explicitly so stated, but rather "one or more". Moreover, it is not necessary for an apparatus or method to address each and every problem sought to be solved by the presently described concept, for it to be encompassed hereby.

The invention claimed is:

1. A sink plug, comprising:

an integrally formed bottom part having a floor and side walls;

a knob having a top part with magnetic properties, attached to the center of the floor;

a removable cover adapted to be disposed on the knob, the removable cover having an underside and comprising a magnet disposed in the center of the cover, wherein in an operating position, the magnet magnetically engages with the knob, wherein the sink plug is adjustable between a first position and a second position, wherein the first position is a position in which the removable cover and the floor of the bottom part are substantially parallel and spaced apart, and substantially perpendicular to a vertical axis, and the second position is a position in which the floor is substantially perpendicular to the vertical axis, the cover is at an angle of approximately 10° to 45° relative to the floor and wherein, in the second position, the underside of the cover engages with the top part of the knob, such that the cover is locked in place by engaging with the floor of the bottom part and the top part of the knob.

2. The sink plug according to claim 1, wherein the floor and the cover are circular.

3. The sink plug according to claim 2, wherein a diameter of the cover is smaller than a diameter of the bottom part.

4. The sink plug according to claim 1, further comprising a plurality of draining holes.

5. A sink arrangement, comprising:

a sink;

a sink outlet;

a sink plug according to claim 1, connected to the sink outlet;

wherein the sink arrangement has a first state and a second state, wherein the first state is a sealed state in which no fluids may pass through the sink plug into the sink outlet, and the second state is an open state in which fluids may pass through the sink plug to the sink outlet, further wherein the sink plug has a first position and second position, wherein the first position is a position in which the removable cover and the floor of the bottom part are substantially parallel and spaced apart, and substantially perpendicular to a vertical axis, and the second position is a position in which the floor is substantially perpendicular to the vertical axis and wherein the cover is at an angle of approximately 10° to 45° relative to the floor and wherein, in the second position, the underside of the cover engages with the top part of the knob, such that the cover is locked in place by engaging with the floor of the bottom part and the top part of the knob.

6. The sink arrangement according to claim 5, wherein the sink plug is adapted to be removable from the sink outlet in the second position.

7. A sink plug, comprising:

an integrally formed bottom part having a floor and side walls;

a knob having a top part with magnetic properties, attached to the center of the floor;

a removable cover adapted to be disposed on the knob, the removable cover having an underside and comprising a magnet disposed in the center of the cover, wherein in an operating position, the magnet magnetically engages with the knob, wherein the sink plug is adjustable between a first position and a second position, wherein the first position is a position in which the removable cover and the floor of the bottom part are substantially parallel and spaced apart, and substantially perpendicular to a vertical axis, and the second position is a position in which the floor is substantially perpendicular to the vertical axis, the cover is at an angle between 0° to 90° relative to the floor and wherein, in the second position, the underside of the cover engages with the top part of the knob, such that the cover is locked in place by engaging with the floor of the bottom part and the top part of the knob.

* * * * *